US012173390B2

(12) United States Patent
Kim

(10) Patent No.: US 12,173,390 B2
(45) Date of Patent: Dec. 24, 2024

(54) ELECTRICAL STEEL SHEET AND MANUFACTURING METHOD THEREFOR

(71) Applicant: POSCO, Pohang-si (KR)

(72) Inventor: Hyun Jong Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 614 days.

(21) Appl. No.: 17/297,789

(22) PCT Filed: Nov. 26, 2019

(86) PCT No.: PCT/KR2019/016385
§ 371 (c)(1),
(2) Date: May 27, 2021

(87) PCT Pub. No.: WO2020/111740
PCT Pub. Date: Jun. 4, 2020

(65) Prior Publication Data

US 2022/0025494 A1 Jan. 27, 2022

(30) Foreign Application Priority Data

Nov. 30, 2018 (KR) ..... 10-2018-0153081

(51) Int. Cl.

| | |
|---|---|
| ***C22C 38/34*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |

(52) U.S. Cl.
CPC ..... *C22C 38/34* (2013.01); *C21D 8/0205* (2013.01); *C21D 8/0226* (2013.01); *C21D 8/0236* (2013.01); *C21D 9/46* (2013.01); *C22C 38/001* (2013.01); *C22C 38/02* (2013.01); *C22C 38/04* (2013.01); *C22C 38/06* (2013.01); *C22C 38/28* (2013.01)

(58) Field of Classification Search
None
See application file for complete search history.

(56) References Cited

U.S. PATENT DOCUMENTS

| | | | |
|---|---|---|---|
| 5,342,454 | A | 8/1994 | Hayakawa et al. |
| 2012/0305140 | A1 | 12/2012 | Yamazaki et al. |
| 2016/0125986 | A1 | 5/2016 | Jensen et al. |

FOREIGN PATENT DOCUMENTS

| | | | |
|---|---|---|---|
| CN | 107245564 | A | 10/2017 |
| EP | 3653758 | A1 | 5/2020 |

(Continued)

OTHER PUBLICATIONS

Request for Opposition issued Mar. 12, 2024 for Japanese Patent Application No. 2021-531297.

(Continued)

*Primary Examiner* — Anthony M Liang
(74) *Attorney, Agent, or Firm* — Morgan, Lewis & Bockius LLP

(57) ABSTRACT

A manufacturing method of an electrical steel sheet according to an embodiment of the present invention includes: hot-rolling a slab to manufacture a hot-rolled sheet; removing some of scales formed on the hot-rolled sheet and leaving a scale layer having a thickness of 10 nm or more; controlling roughness of the hot-rolled sheet in which the scale layer remains; cold-rolling it to manufacture a cold-rolled sheet; and annealing the cold-rolled sheet.

3 Claims, 7 Drawing Sheets

(56) References Cited

FOREIGN PATENT DOCUMENTS

| | | | |
|---|---|---|---|
| JP | H05186832 | A | 7/1993 |
| JP | H6-286133 | A | 10/1994 |
| JP | H9-256060 | A | 9/1997 |
| JP | 2000-104143 | A | 4/2000 |
| JP | 2001-073096 | A | 3/2001 |
| JP | 2005-76124 | A | 3/2005 |
| JP | 2006-503189 | A | 1/2006 |
| JP | 2006-28635 | A | 2/2006 |
| JP | 2007-50104 | A | 3/2007 |
| JP | 2011-157603 | A | 8/2011 |
| JP | 2015-183203 | A | 10/2015 |
| JP | 2017-61749 | A | 3/2017 |
| JP | 2017-197806 | A | 11/2017 |
| JP | 2018-021241 | A | 2/2018 |
| JP | 2018-053346 | A | 4/2018 |
| JP | 2018-066036 | A | 4/2018 |
| JP | 2018-066061 | A | 4/2018 |
| JP | 2018-135556 | A | 8/2018 |
| JP | 2018-522378 | A | 8/2018 |
| KR | 10-10595577 | B1 | 8/2011 |
| KR | 10-2012-0105051 | A | 9/2012 |
| KR | 10-1185224 | B1 | 9/2012 |
| WO | 2011/102328 | A1 | 8/2011 |

OTHER PUBLICATIONS

Office Action issued May 2, 2024 for Japanese Patent Application No. 2021-531297.

Hearing Notice issued Apr. 9, 2024 for Indian Patent Application No. 202137025890 (See Partial Translation).

Extended European Search Report dated Jan. 4, 2022 issued in European Patent Application No. 19889823.1.

Indian Office Action dated Feb. 18, 2022 issued in Indian Patent Application No. 202137025890 (with English translation).

Japanese Office Action dated May 24, 2022 issued in Japanese Patent Application No. 2021-531297.

International Search Report issued in corresponding International Patent Application No. PCT/KR2019/016385 dated Jun. 26, 2020.

ELECTRICAL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/016385, filed on Nov. 26, 2019, which claims the benefit of Korean Patent Application No. 10-2018-0153081, filed on Nov. 30, 2018, the entire disclosures of each are incorporated by reference herein.

TECHNICAL FIELD

The present invention relates to an electrical steel sheet and a manufacturing method thereof. More specifically, the present invention relates to an electrical steel sheet and a manufacturing method thereof in which, after a hot-rolled sheet is manufactured, some scales present on a surface of the hot-rolled sheet remain to improve insulating properties, and to improve a close contacting property with an insulating coating layer.

BACKGROUND ART

An electrical steel sheet is a product used as a material for a transformer, a motor, and an electric machine, and unlike a general carbon steel that places importance on processability such as mechanical properties, it is a functional product that places importance on electrical properties. The required electric properties include low iron loss, high magnetic flux density, high magnetic permeability, and a high stacking factor.

The electrical steel sheet is classified into a grain-oriented electrical steel sheets and a non-oriented electrical steel sheet. The grain-oriented electrical steel sheet has excellent magnetic properties in a rolling direction by forming a Goss texture ({110}<001> texture) on an entire steel sheet by using an abnormal grain growth phenomenon called secondary recrystallization. The non-oriented electrical steel sheet is an electrical steel sheet with uniform magnetic properties in all directions on a rolled sheet.

In a production process of the non-oriented electrical steel sheet, a slab is manufactured, and then hot-rolled, cold-rolled, and final-annealed to form an insulating coating layer.

In a production process of the grain-oriented electrical steel sheet, a slab is manufactured, and then hot-rolled, cold-rolled, primary-recrystallization-annealed, and secondary-recrystallization-annealed to form an insulating coating layer.

In the production process of the electrical steel sheet, after hot-rolling, it is common to remove scales generated on a surface thereof to improve efficiency of a subsequent process.

However, a large amount of Fe exists on the surface of the steel sheet after pickling, and the surface of the steel sheet does not have a large binding force with OH and O functional groups. When an insulating coating layer containing an oxide composed of O and OH components on such a surface is formed, the insulating coating layer may not be uniformly formed, and close contacting force between the steel sheet and the insulating coating layer may be deteriorated.

DISCLOSURE

An electrical steel sheet and a manufacturing method thereof are provided. More specifically, an electrical steel sheet and a manufacturing method thereof in which, after a hot-rolled sheet is manufactured, some scales present on a surface of the hot-rolled sheet remain to improve insulating properties, and a close contacting property with an insulating coating layer, are provided.

A manufacturing method of an electrical steel sheet according to an embodiment of the present invention includes: hot-rolling a slab to manufacture a hot-rolled sheet; removing some of scales formed on the hot-rolled sheet and maintaining a scale layer having a thickness of 10 nm or more; controlling roughness of the hot-rolled sheet in which the scale layer remains; cold-rolling it to manufacture a cold-rolled sheet; and annealing the cold-rolled sheet.

The slab may include, in wt %, C at 0.1% or less, Si at 6.0% or less, P at 0.5% or less, S at 0.005% or less, Mn at 1.0% or less, Al at 2.0% or less, N at 0.005% or less, Ti at 0.005% or less, Cr at 0.5% or less, and the balance of Fe and inevitable impurities.

The scale may include Si at 5 to 80 wt %, O at 5 to 80 wt %, and the balance of Fe and inevitable impurities.

In the leaving of the scale, by using a blast method, an inputted amount of particles may be treated to be 20 $g/m^3$ to 1000 $g/m^3$ per area of a steel sheet, and a speed of the particles may be treated to be 0.1 km/s to 200 km/s.

In the controlling of the roughness of the hot-rolled sheet, the roughness may be controlled to be 0.1 to 2.0 nm.

The controlling of the roughness of the hot-rolled sheet may include passing the hot-rolled sheet between blades coated with rubber.

Elasticity of the rubber may be 7 to 45 MPa.

After the controlling of the roughness of the hot-rolled sheet, pickling may be further included.

The pickling may be immersing in an acid solution of 15 wt % or less for 20 to 70 seconds.

After the manufacturing of the cold-rolled sheet, a thickness of the scale layer may be 1 to 100 nm.

After the manufacturing of the cold-rolled sheet, roughness of the scale layer may be 0.01 to 0.5 nm.

An embodiment of the present invention provides an electrical steel sheet including: an electrical steel sheet base substrate; and a scale layer present in an inner direction from a surface of the electrical steel sheet base substrate, wherein a thickness of the scale layer is 1 to 100 nm.

The scale layer may include Si at 5 to 80 wt %, O at 5 to 80 wt %, and the balance of Fe and inevitable impurities.

The scale layer may have roughness of 0.01 to 0.5 nm.

The electrical steel sheet may further include an insulating coating layer positioned on the scale layer.

According to the embodiment of the present invention, it is possible to improve a close contacting property with an insulating coating layer by forming a solid bond between the insulating coating layer and a scale layer.

In addition, according to the embodiment of the present invention, an insulating property exists in a scale layer itself, so that the insulating property may be improved.

Further, according to the embodiment of the present invention, when a hot-rolled coil is in a standby state, it is possible to prevent oxidation of a hot rolled sheet from oxygen in the air.

MODE FOR INVENTION

Figure 1:
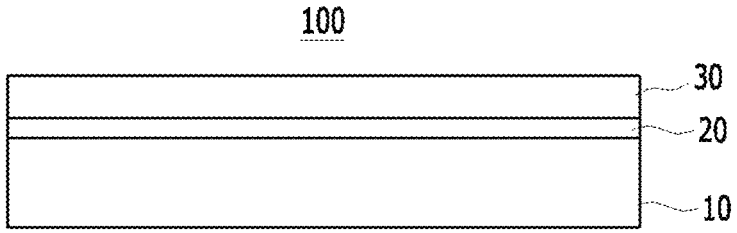
FIG. 1 illustrates a schematic view of a cross-section of an electrical steel sheet according to an embodiment of the present invention.

It will be understood that, although the terms first, second, third, etc. may be used herein to describe various elements, components, regions, layers, and/or sections, they are not limited thereto. These terms are only used to distinguish one element, component, region, layer, or section from another element, component, region, layer, or section. Therefore, a first part, component, area, layer, or section to be described below may be referred to as second part, component, area, layer, or section within the range of the present invention.

The technical terms used herein are to simply mention a particular embodiment and are not meant to limit the present invention. An expression used in the singular encompasses an expression of the plural, unless it has a clearly different meaning in the context. In the specification, it is to be understood that the terms such as "including", "having", etc., are intended to indicate the existence of specific features, regions, numbers, stages, operations, elements, components, and/or combinations thereof disclosed in the specification, and are not intended to preclude the possibility that one or more other features, regions, numbers, stages, operations, elements, components, and/or combinations thereof may exist or may be added.

When referring to a part as being "on" or "above" another part, it may be positioned directly on or above another part, or another part may be interposed therebetween. In contrast, when referring to a part being "directly above" another part, no other part is interposed therebetween.

Unless otherwise stated, % means wt %, and 1 ppm is 0.0001 wt %.

In embodiments of the present invention, inclusion of an additional element means replacing the balance of iron (Fe) by an additional amount of the additional elements.

Unless otherwise defined, all terms used herein, including technical or scientific terms, have the same meanings as those generally understood by those with ordinary knowledge in the field of art to which the present invention belongs. Terms defined in commonly used dictionaries are further interpreted as having meanings consistent with the relevant technical literature and the present disclosure, and are not to be construed as having idealized or very formal meanings unless defined otherwise.

The present invention will be described more fully hereinafter with reference to the accompanying drawings, in which embodiments of the invention are shown. As those skilled in the art would realize, the described embodiments may be modified in various different ways, all without departing from the spirit or scope of the present invention.

A manufacturing method of an electrical steel sheet according to an embodiment of the present invention includes: hot-rolling a slab to manufacture a hot-rolled sheet; removing some of scales formed on the hot-rolled sheet and leaving a scale layer having a thickness of 10 nm or more; controlling roughness of the hot-rolled sheet in which the scale layer remains; cold-rolling it to manufacture a cold-rolled sheet; and annealing the cold-rolled sheet.

Hereinafter, respective steps will be specifically described.

First, the slab is hot-rolled to manufacture the hot-rolled sheet.

The alloy components of the slab are not particularly limited, and all alloy components used in the electrical steel sheet may be used. For example, the slab may include, in wt %, C at 0.1% or less, Si at 6.0% or less, P at 0.5% or less, S at 0.005% or less, Mn at 1.0% or less, Al at 2.0% or less, N at 0.005% or less, Ti at 0.005% or less, Cr at 0.5% or less, and the balance of Fe and inevitable impurities.

First, the slab is heated. The heating temperature of the slab is not limited, but when the slab is heated at a temperature of 1300° C. or less, by preventing coarse growth of a columnar structure of the slab, cracks in the sheet may be prevented in the hot-rolling process. Therefore, the heating temperature of the slab may be 1050° C. to 1300° C.

Next, the slab is hot-rolled to manufacture the hot-rolled sheet. The hot-rolling temperature is not limited, and for example, the hot rolling may be terminated at 950° C. or less.

Next, some of the scales formed on the hot-rolled sheet are removed, and scales having a thickness of 10 nm or more remain.

Since the hot-rolling is performed at a high temperature, the scales are inevitably generated on the surface of the hot-rolled sheet. These scales adversely affect magnetism, and thus fracture occurs during rolling, so that it is common to remove all of the scales.

In the embodiment of the present invention, by intentionally leaving the scale layer having a thickness of 10 nm or more, a close contacting property to the insulating coating layer may be improved, and additional insulating properties may be obtained. In the scale, an Fe content is less than that of the steel sheet base substrate, and instead a Si content is relatively high, so that bonding strength with the OH and O components acts greatly. Therefore, when the insulating coating layer is formed, the insulating coating layer is uniformly formed and the close contacting force is improved.

In the scale, an O content is higher than that of the steel sheet base substrate, so that insulating properties are imparted by itself.

Specifically, the scale may include Si at 5 to 80 wt %, O at 5 to 80 wt %, and the balance of Fe and inevitable impurities. More specifically, the scale may include Si at 10 to 60 wt %, O at 10 to 60 wt %, and the balance of Fe and inevitable impurities. More specifically, the scale may include Si at 15 to 40 wt %, O at 15 to 40 wt %, and the balance of Fe and inevitable impurities.

The method of leaving the scale is not particularly limited. For example, it may be processed by using a blast method. The blast method is a method of removing scales by colliding fine particles with a steel sheet at a high speed. In this case, the inputted amount of the particles may be 20 g/m$^3$ to 1000 g/m$^3$ per area of the steel sheet, and the speed of the particles may be 0.1 km/s to 200 km/s. More specifically, the inputted amount of the particles may be 100 g/m$^3$ to 750 g/m$^3$ per area of the steel sheet, and the speed of the particles may be 1 km/s to 100 km/s.

Compared with the existing blast method, which removes all of the scales, the inputted amount and speed of fine particles are less. As such, the scales may be left in an appropriate thickness by the blast method described above. When it is larger or smaller than the above-described range, the scales with an appropriate thickness may not be left.

In the embodiment of the present invention, the thickness of the scale remaining is 10 nm or more. The thickness of the scale may be non-uniform throughout the entire steel sheet, and thus unless otherwise specified, the thickness of the scale means an average thickness of the entire steel sheet. When the thickness of the scale remains too thick, it may adversely affect the magnetism. Therefore, the thickness of the remaining scale may be 10 nm to 300 nm. More specifically, the thickness of the remaining scale may be 30 to 150 nm.

Next, the roughness of the hot-rolled sheet in which the scale remains is controlled. In this case, the roughness of the hot-rolled sheet means the roughness of the outermost surface of the hot-rolled sheet, that is, the roughness of the scale. When the scale remains, the roughness becomes very large. This adversely affects magnetism. Therefore, it is required to control only the roughness without removing the scale.

In the embodiment of the present invention, it is possible to control the roughness of the hot-rolled sheet to be 0.1 to 2.0 nm through the roughness control. When the roughness is too high, it may adversely affect the magnetism. Conversely, when the roughness is controlled to be too low, there may be a problem that all of the scales are removed. Therefore, it is possible to control the roughness in the above-described range. Specifically, the roughness may be controlled to be 1.0 to 1.5 nm.

A method of controlling the roughness may include passing a hot-rolled sheet between blades coated with rubber.

In this case, an elasticity of the rubber may be 7 to 45 MPa. When the elasticity is not appropriate, it may be difficult to control the roughness.

After the controlling of the roughness of the hot-rolled sheet, pickling may be further included. The roughness of the hot-rolled sheet may be further controlled through the pickling. During the pickling, when a concentration of an acid solution is high, or when an immersion time is long, there may be a problem that all of the scales are removed. Therefore, it may be immersed in an acid solution of 15 wt % or less for 20 to 70 seconds.

Next, the hot-rolled sheet is cold-rolled to manufacture a cold-rolled sheet. Although It may be applied differently depending on the thickness of the hot-rolled sheet, the cold-rolling may be performed so that the final thickness thereof becomes 0.2 to 0.65 mm, by applying a reduction ratio of 70 to 95%. The cold-rolling may be performed by one cold-rolling or, if necessary, by two or more cold-rollings with intermediate annealing interposed therebetween.

In the cold-rolling process, the scale layer is also rolled and a thickness thereof becomes smaller. After the cold-rolling, the thickness of the scale layer may be 1 to 100 nm. More specifically, it may be 5 to 20 nm.

Next, the cold-rolled sheet is annealed. In this case, the annealing of the cold-rolled sheet is varied depending on the use of the non-oriented electrical steel sheet or the grain-oriented electrical steel sheet.

Specifically, in the case of manufacturing the non-oriented electrical steel sheet, the annealing may be performed for 30 seconds to 3 minutes at a temperature of 850 to 1050° C. When a cracking temperature thereof is too high, rapid grain growth may occur, and the magnetic flux density and high-frequency iron loss may be deteriorated. Specifically, the final annealing may be performed at the cracking temperature of 900 to 1000° C. In the final annealing process, the texture formed in the previous cold-rolling step may be entirely (that is, 99% or more) recrystallized.

When the grain-oriented electrical steel sheet is manufactured, the cold-rolled cold-rolled sheet is subjected to the primary recrystallization annealing. In the primary recrystallization annealing process, primary recrystallization occurs in which nuclei of Goss grains are generated. During the primary recrystallization annealing process, the steel sheet may be decarburized and nitrided. For decarburizing and nitriding, the primary recrystallization annealing may be performed under a mixed gas atmosphere of steam, hydrogen, and ammonia.

Nitrogen ions are introduced into the steel sheet by using ammonia gas for nitriding to form nitrides such as (Al, Si, Mn)N and AlN, which are main precipitates, and in this case, there is no problem with effects of the present invention even in any one of a method of nitriding after decarburizing, a method of performing nitriding so that the nitriding may be simultaneously performed with decarburizing, and a method of first performing nitriding and then decarburizing.

The primary recrystallization annealing may be performed in a temperature range of 800 to 900° C.

Next, the cold-rolled sheet in which the primary recrystallization annealing is completed is subjected to the secondary recrystallization annealing. In this case, after an annealing separator is applied to the cold rolled sheet in which the primary recrystallization annealing is completed, the secondary recrystallization annealing may be performed. In this case, the annealing separator is not particularly limited, and an annealing separator containing MgO as a main component may be used.

The purpose of the secondary recrystallization annealing is largely to form a {110}<001> texture by the secondary recrystallization, insulation-imparting by the formation of a glassy film by reaction between the oxide layer formed during the decarburizing and MgO, and removal of impurities that degrade magnetic properties. In the method of the secondary recrystallization annealing, in the heating section before the secondary recrystallization occurs, the mixture of nitrogen and hydrogen is maintained to protect the nitride, which is a particle growth inhibitor, so that the secondary recrystallization may develop well, and after the secondary recrystallization is completed, impurities are removed by maintaining it in a 100% hydrogen atmosphere for a long time.

Next, forming an insulating coating layer may be included. Except for thinning a thickness thereof, the insulating layer may be formed by using a typical method. The method of forming the insulating coating layer is widely known in the field of electrical steel sheet technology, so a detailed description thereof is omitted.

FIG. 1 illustrates a schematic view of a cross-section of an electrical steel sheet 100 according to an embodiment of the present invention. A structure of an electrical steel sheet according to an embodiment of the present invention will be described with reference to FIG. 1. However, the electrical steel sheet of FIG. 1 is only for illustrating the present invention, and the present invention is not limited thereto. Therefore, a structure of the electrical steel sheet may be variously modified.

As shown in FIG. 1, the electrical steel sheet 100 according to the embodiment of the present invention includes a scale layer 20 present in an inner direction from a surface of an electrical steel sheet base substrate 10. By including the scale layer 20 as described above, a solid bond between an insulating coating layer 30 and the scale layer 20 may be formed, thereby improving a close contacting property with the insulating coating layer 30. In addition, since an insulating property exists in the scale layer 20 itself, the insulating property may be improved.

Hereinafter, each configuration will be described in detail.

First, all of the alloy components used in the electrical steel sheet may be used in the electrical steel sheet base substrate 10. For example, the electrical steel sheet base substrate 10 may include, in wt %, C at 0.1% or less, Si at 6.0% or less, P at 0.5% or less, S at 0.005% or less, Mn at 1.0% or less, Al at 2.0% or less, N at 0.005% or less, Ti at 0.005% or less, Cr at 0.5% or less, and the balance of Fe and inevitable impurities.

The scale layer 20 exists in the inner direction from the surface of the electrical steel base substrate 10. A thickness of the scale layer 20 may be 1 to 100 nm. Specifically, it may be 5 to 20 nm. When the scale layer 20 is too thin, it is difficult to appropriately obtain the effects of improving the close contacting property with the insulating coating layer 30 and improving the insulating property, by the presence of the scale layer 20 described above. In addition, when the scale layer 20 is too thick, it may adversely affect magnetism. Therefore, the thickness of the scale layer 20 may be 1 to 100 nm. Specifically, it may be 5 to 20 nm.

The scale layer 20 may include Si at 5 to 80 wt %, O at 5 to 80 wt %, and the balance of Fe and inevitable impurities. Specifically, the scale may include Si at 10 to 60 wt %, O at 10 to 60 wt %, and the balance of Fe and inevitable impurities. More specifically, the scale may include Si at 15 to 40 wt %, O at 15 to 40 wt %, and the balance of Fe and inevitable impurities.

In the scale layer 20, an Fe content is less than that of the steel sheet base substrate 10, and instead a Si content is relatively high, so that bonding strength with the OH and O components acts greatly. Therefore, when the insulating coating layer 30 is formed, the insulating coating layer 30 is uniformly formed, and thus close contacting force is improved. In addition, the scale layer 20 has a higher O content than that of the electrical steel sheet base substrate 10, so that an insulating property is imparted by itself.

Figure 6:
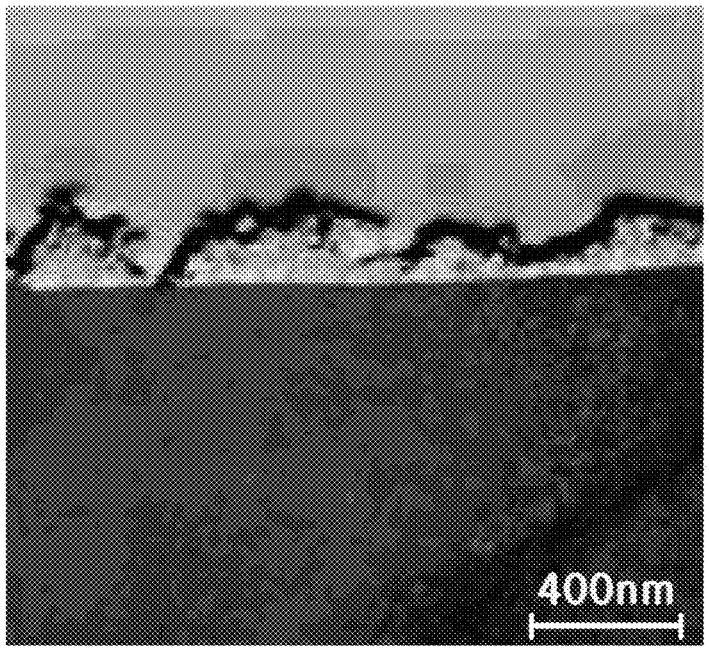
FIG. 6 illustrates a scanning electron microscope (SEM) photograph of a cross-section of a steel sheet after cold-rolling in an example.

In FIG. 1, although the surface (that is, an interface between the scale layer 20 and the insulating coating layer 30) of the scale layer 20 is illustrated to be flat, but it is substantially considerably roughly formed as shown in FIG. 6. The scale layer 20 may have roughness of 0.01 to 0.5 nm. When the roughness is too high, it may adversely affect the magnetism. Conversely, when the roughness is controlled to be too low, there may be a problem that all of the scale layer 20 is removed. Therefore, it is possible to control the roughness of the scale layer 20 in the above-described range.

As shown in FIG. 1, the insulating coating layer 30 may be further formed on the scale layer 20. In the embodiment of the present invention, since the scale layer 20 is properly formed, the close contacting property of the insulating coating layer 30 may be improved, and even if the thickness of the insulating coating layer 30 is formed thin, sufficient insulation may be secured. Specifically, the thickness of the insulating coating layer 30 may be 0.7 to 1.0 μm. The insulating coating layer 30 is widely known in the field of the electrical steel sheet technology, so a detailed description thereof is omitted.

Hereinafter, the present invention will be described in more detail through an example. However, the example is only for illustrating the present invention, and the present invention is not limited thereto.

Example

A slab including silicon (Si) of 3.4 wt % and the balance of Fe and other inevitable impurities was prepared.

The slab was heated at 1130° C. and then hot-rolled to a thickness of 2.3 mm to manufacture a hot-rolled sheet.

The hot-rolled sheet was controlled at a fine particle input amount of about 650 g/m$^3$ and an input speed of about 50 km/s by using a shot blaster so that a scale layer having a thickness of about 100 nm remained. After that, it was passed through blades coated with rubber with elasticity of about 30 MPa to be controlled to have the surface roughness of about 1.5 nm. Next, it was immersed for about 50 seconds in a hydrochloric acid solution (about 15 wt %) at a temperature of about 70° C. and then pickled. Next, it was cleaned.

Figure 2:
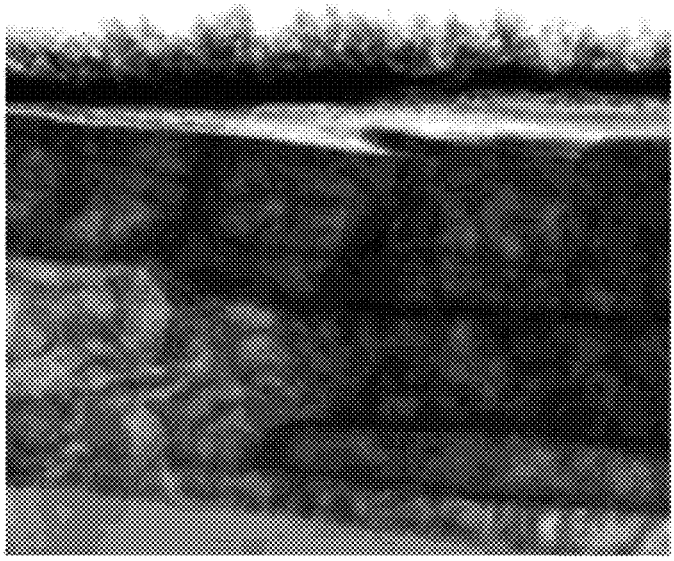
FIG. 2 illustrates a scanning electron microscope (SEM) photograph of a cross-section of a steel sheet after pickling in an example.

FIG. 2 illustrates a scanning electron microscope (SEM) photograph of a cross-section of the steel sheet after the pickling. As shown in FIG. 2, the scale layer is indicated by a white portion, and it can be seen that the scale layer remains.

Figure 3:
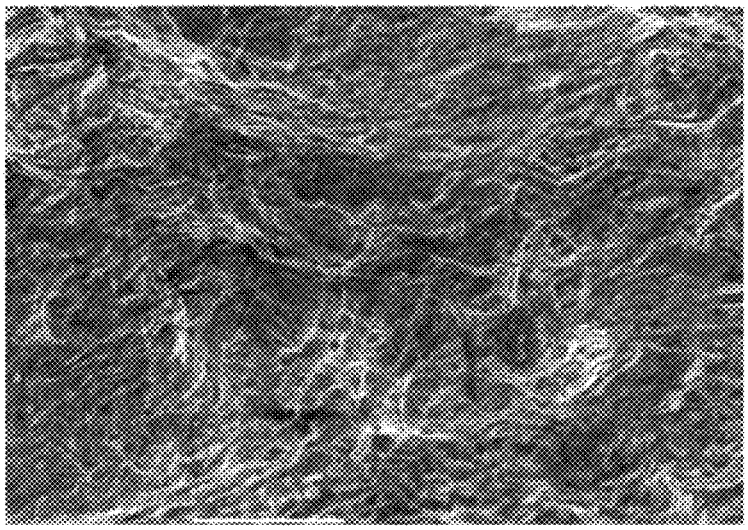
FIG. 3 illustrates a scanning electron microscope (SEM) photograph of a surface of a steel sheet after pickling in an example.

FIG. 3 illustrates a scanning electron microscope (SEM) photograph of a surface of the steel sheet after the pickling. As shown in FIG. 3, it can be seen that a feather-shaped scale layer covers the surface of the steel sheet.

After that, it was cold-rolled to have a sheet thickness of 0.25 mm and then final-annealed. The cross-sections of the steel sheet are shown in FIG. 6 and FIG. 7.

Figure 7:
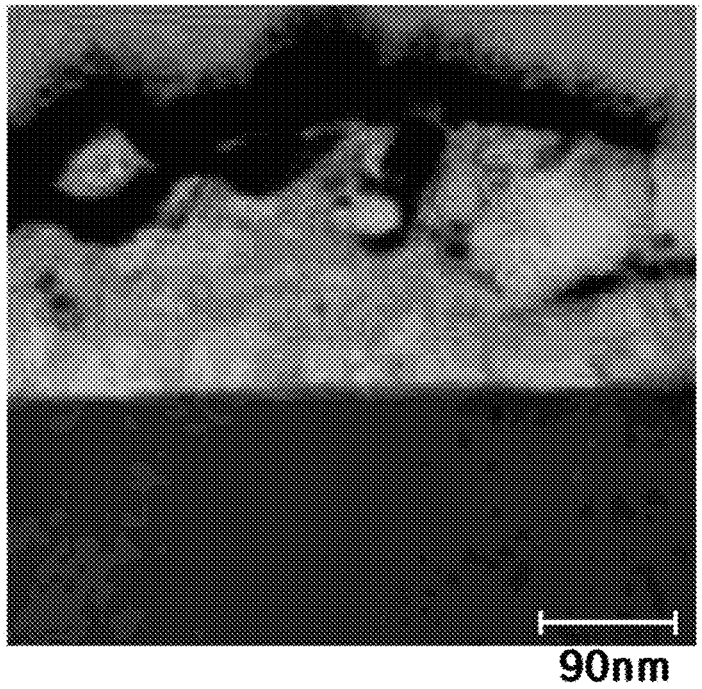
FIG. 7 illustrates a scanning electron microscope (SEM) photograph of a cross-section of a steel sheet after cold-rolling in an example.

As shown in FIG. 6 and FIG. 7, it can be seen that the scale layer remains even after the cold-rolling and the final-annealing.

It was confirmed that the thickness of the scale layer was about 50 nm and the roughness thereof was about 0.1 nm. In addition, the alloy component of the scale layer was analyzed by TEM-FIB. It was confirmed that it included Si at 35.25 wt %, O at 34.02 wt %, and the balance of Fe and impurities.

In addition, it was confirmed that an area fraction of the scale was 30% or more in an area of 2 μm×2 μm.

Comparative Example 1

A slab including silicon (Si) of 3.4 wt % and the balance of Fe and other inevitable impurities was prepared.

The slab was heated at 1130° C. and then hot-rolled to a thickness of 2.3 mm to manufacture a hot-rolled sheet.

The hot-rolled sheet was controlled at a fine particle input amount of 1300 g/m$^3$ and an input speed of 50 km/s by using a shot blaster, so that all of the scale layer was removed. Next, it was immersed for about 100 seconds in a hydrochloric acid solution (about 30 wt %) at a temperature of about 80° C. and then pickled. Next, it was cleaned.

Figure 4:
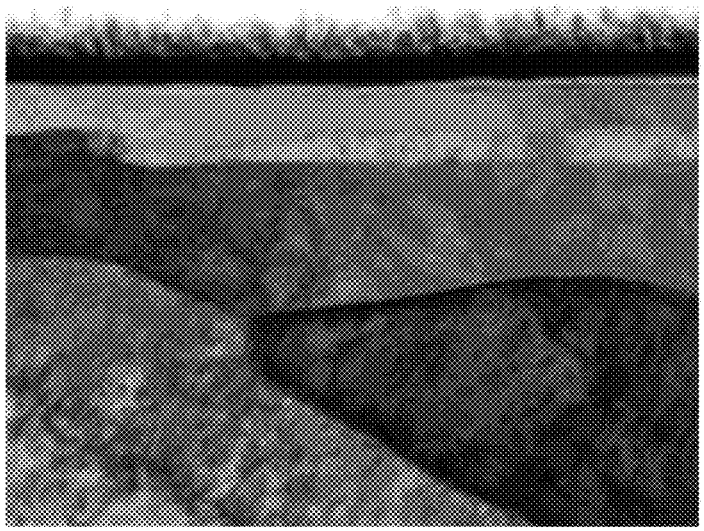
FIG. 4 illustrates a scanning electron microscope (SEM) photograph of a cross-section of a steel sheet after hot-rolling in a comparative example.

FIG. 4 illustrates a scanning electron microscope (SEM) photograph of a cross-section of the steel sheet after the pickling. As shown in FIG. 4, it can be seen that all of the scale layer is removed.

Figure 5:
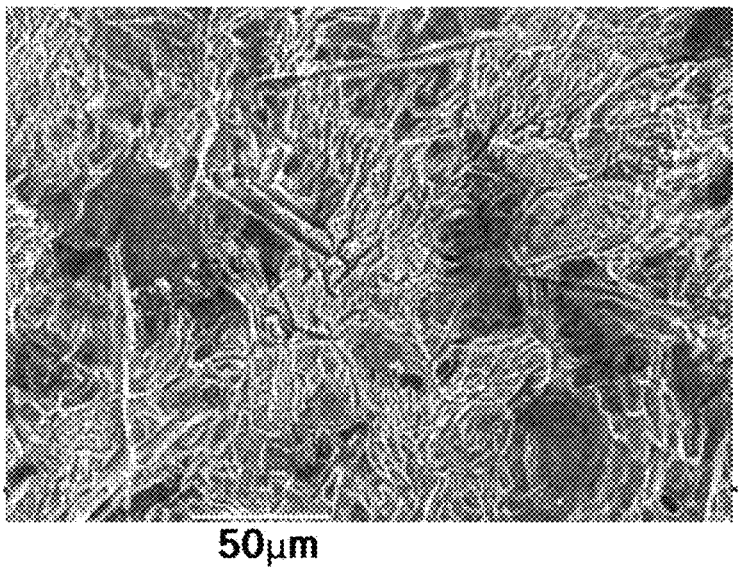
FIG. 5 illustrates a scanning electron microscope (SEM) photograph of a surface of a steel sheet after hot-rolling in a comparative example.

FIG. 5 illustrates a scanning electron microscope (SEM) photograph of a surface of the steel sheet after the pickling.

As shown in FIG. 5, there is no feather-shaped scale layer, and only scratches are observed on the steel sheet.

Next, it was cold-rolled to have a sheet thickness of 0.25 mm and then final-annealed.

In addition, it was confirmed that an area fraction of the scale was 10% in an area of 2 μm×2 μm.

Comparative Example 2

A slab including silicon (Si) at 3.4 wt % and the balance of Fe and other inevitable impurities was prepared.

The slab was heated at 1130° C. and then hot-rolled to a thickness of 2.3 mm to manufacture a hot-rolled sheet.

The hot-rolled sheet was controlled at a fine particle input amount of about 80 g/m$^3$ and an input speed of about 50 km/s by using a shot blaster so that a scale layer having a thickness of about 500 nm remained. Next, it was immersed for about 50 seconds in a hydrochloric acid solution (about 15 wt %) at a temperature of about 70° C. and then pickled. Next, it was cleaned. After that, it was cold-rolled to have a sheet thickness of 0.25 mm and then final-annealed. After the cold rolling, a scale layer of about 250 nm was observed.

Experimental Example 1: Confirmation of Rust Formation

In the example and comparative examples, after the pickling and cleaning of the hot-rolled sheet, the hot-rolled sheet was wound before the cold-rolling and then left for the time shown in Table 1.

The gloss was measured at 2 points and shown in Table 1 below. The gloss was expressed by the ratio of the intensity of light when the reflected light was received at the same angle as the incident light by using an ASTM D 523 gloss meter, and the glass surface gloss with a refractive index of 1.567 as 100. In this case, the angle was set to 60 degrees.

TABLE 1

| | Example | | Comparative Example 1 | | Comparative Example 2 |
|---|---|---|---|---|---|
| Immediately after cleaning | 71 | 72 | 80 | 86 | 89 |
| 1 day later | 50 | 46 | 47 | 57 | 61 |
| 2 days later | 50 | 49 | 46 | 55 | 65 |

As shown in Table 1, immediately after washing, the example in which the scale layer was present was deteriorated in gloss compared with the comparative examples. However, after one day and two days, it can be seen that rust formation was prevented by the scale layer in the example, whereas rust was formed in the comparative examples, and the glossiness was remarkably decreased.

Experimental Example 2: Insulating Property Measurement

In the example and comparative examples, after the final annealing, the insulating properties of the steel sheet were measured at 3 points and are shown in Table 2 below. In addition, after forming an insulating coating layer with a thickness of 1 μm, the insulating properties were measured and are shown in Table 2 below. The insulating properties were measured using a Franklin measuring instrument according to an ASTM A717 international standard.

In addition, the close contacting property was determined by the presence or absence of film peeling when the specimen was bent at 180°. When observed under the microscope (×100), if there was no peeling at all, it was marked very good, and if there were 3 or less defects/5 cm×5 cm under ×100, it was marked as good.

Iron loss (W15/50) refers to power loss that occurs when a magnetic field with a frequency of 50 Hz is magnetized to 1.5 Tesla by an alternating current.

TABLE 2

| | Example | | | Comparative Example 1 | | | Comparative Example 2 |
|---|---|---|---|---|---|---|---|
| Insulating property (mA) | 910 | 850 | 880 | 990 | 990 | 990 | 990 |
| Close contacting property (mmφ) | Very good | Very good | Very good | Good | Good | Good | Good |
| Iron loss ($W_{15/50}$, W/kg) | 13.5 | 13.6 | 13.4 | 15.2 | 15.5 | 15.5 | 16.5 |

As shown in Table 2, it can be seen that the example in which the scale layer is present has an excellent insulating property and an improved close contacting property compared with Comparative Example 1. Furthermore, it can be seen that the iron loss is also improved. It can be seen that in Comparative Example 2 in which too much of the scale layer is left, the iron loss is considerably deteriorated.

The present invention may be embodied in many different forms, and should not be construed as being limited to the disclosed embodiments. In addition, it will be understood by those skilled in the art that various changes in form and details may be made thereto without departing from the technical spirit and essential features of the present invention. Therefore, it is to be understood that the above-described embodiments are for illustrative purposes only, and the scope of the present invention is not limited thereto.

DESCRIPTION OF SYMBOLS

100: electrical steel sheet
10: electrical steel sheet base substrate
20: scale layer
30: insulating coating layer

The invention claimed is:

1. An electrical steel sheet comprising:
an electrical steel sheet base substrate; and
a scale layer present in an inner direction from a surface of the electrical steel sheet base substrate,
wherein a thickness of the scale layer is 1 to 100 nm,
wherein roughness (Ra) of the scale layer is 0.01 to 0.5 μm, and
the electrical steel sheet base substrate includes, in wt %, C at 0.1% or less, Si at 6.0% or less, P at 0.5% or less, S at 0.005% or less, Mn at 1.0% or less, Al at 2.0% or less, N at 0.005% or less, Ti at 0.005% or less, Cr at 0.5% or less, and the balance of Fe and inevitable impurities.

2. The electrical steel sheet of claim 1, wherein the scale layer includes: Si at 5 to 80 wt %, O at 5 to 80 wt %, and the balance of Fe and inevitable impurities.

3. The electrical steel sheet of claim 1, further comprising an insulating coating layer positioned on the scale layer.

* * * * *